US009406185B2

(12) United States Patent
Huang et al.

(10) Patent No.: US 9,406,185 B2
(45) Date of Patent: Aug. 2, 2016

(54) FINANCIAL SELF-SERVICE DEVICE, BANKNOTE RECOGNITION MODULE THEREOF AND RECOGNITION METHOD THEREFOR

(71) Applicant: GRG Banking Equipment Co., Ltd., Guangzhou, Guangdong (CN)

(72) Inventors: Guoqiang Huang, Guangzhou (CN); Mengtao Liu, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/416,622

(22) PCT Filed: Apr. 2, 2013

(86) PCT No.: PCT/CN2013/073640

§ 371 (c)(1),
(2) Date: Jan. 22, 2015

(87) PCT Pub. No.: WO2014/063469

PCT Pub. Date: May 1, 2014

(65) Prior Publication Data

US 2015/0269804 A1 Sep. 24, 2015

(30) Foreign Application Priority Data

Oct. 25, 2012 (CN) ..... 2012 1 0413529

(51) Int. Cl.
*G07D 7/00* (2006.01)
*G07D 11/00* (2006.01)
(Continued)

(52) U.S. Cl.
CPC ..... *G07D 11/0021* (2013.01); *G06M 7/06* (2013.01); *G07D 7/06* (2013.01); *G07D 7/12* (2013.01);
(Continued)

(58) Field of Classification Search
CPC . G07D 7/00; G07D 11/0021; G07D 11/0084; G07D 2211/00
USPC ..... 194/206, 207, 216; 209/534; 235/379; 382/135
See application file for complete search history.

(56) References Cited

U.S. PATENT DOCUMENTS 6,839,458 B2 * 1/2005 Mukai ..... G07D 7/20 382/135
7,934,601 B2 * 5/2011 Matsuura ..... G07D 7/2058 194/206
(Continued)

FOREIGN PATENT DOCUMENTS

CN 1710606 A 12/2005
CN 200986718 Y 12/2007
(Continued)

OTHER PUBLICATIONS

International Search Report dated Aug. 15, 2013 from corresponding International Application No. PCT/CN2013/073640, (3 pages).
(Continued)

*Primary Examiner* — Mark Beauchaine
(74) *Attorney, Agent, or Firm* — Wolf, Greenfield & Sacks, P.C.

(57) ABSTRACT

A recognition module comprises a detection unit for real-time detection and control of a banknote moving state, wherein at least one group of the through-beam sensors comprises a first sensor and two second sensors, the first sensor whereof is arranged on a midline of a banknote transmission channel, and the two second sensors are arranged at the upstream position of the banknote moving direction relative to the first sensor and are symmetrically distributed on the two sides of the midline of the banknote transmission channel. The condition for judging whether a start signal of an image data acquisition unit is effective is whether a banknote-triggered insertion event is detected by the first sensor; and the condition for judging whether an end signal of the acquisition unit is effective is whether a banknote-exit completion event is detected by three through-beam sensors.

7 Claims, 4 Drawing Sheets

(51) Int. Cl.

| | |
|---|---|
| ***G07D 7/06*** | (2006.01) |
| ***G06M 7/06*** | (2006.01) |
| ***G07D 7/12*** | (2016.01) |
| ***G07D 7/16*** | (2016.01) |
| ***G07F 7/04*** | (2006.01) |
| ***G07F 19/00*** | (2006.01) |

(52) U.S. Cl.

CPC ..... *G07D 7/121* (2013.01); *G07D 7/168* (2013.01); *G07D 11/0018* (2013.01); *G07D 11/0084* (2013.01); *G07F 7/04* (2013.01); *G07F 19/202* (2013.01)

(56) References Cited

U.S. PATENT DOCUMENTS

| | | | | |
|---|---|---|---|---|
| 2002/0017445 | A1 * | 2/2002 | Mukai ..... | G07D 7/20 194/207 |
| 2008/0283450 | A1 | 11/2008 | Hemming et al. | |
| 2010/0282846 | A1 | 11/2010 | Won et al. | |

FOREIGN PATENT DOCUMENTS

| | | | | |
|---|---|---|---|---|
| CN | 101529479 | A | 9/2009 | |
| CN | 101916470 | A | 12/2010 | |
| CN | 102136166 | A | 7/2011 | |
| CN | 102289859 | A | 12/2011 | |
| CN | 102693579 | A | 9/2012 | |
| CN | 102930633 | A | 2/2013 | |
| EP | 2410496 | A1 | 1/2012 | |
| JP | H 03163687 | A | 7/1991 | |
| JP | H 4160587 | A | 6/1992 | |
| JP | H 0896201 | A | 4/1996 | |
| JP | H 10222717 | A | 8/1998 | |
| JP | 2005107763 | A | 4/2005 | |
| JP | 2008183474 | A | 8/2008 | |
| JP | 2009043014 | A | 2/2009 | |
| WO | 99/28829 | | 6/1999 | |
| WO | 02/077933 | A1 | 10/2002 | |
| WO | WO 02/077933 | A1 * | 10/2002 | ..... G07D 7/16 |

OTHER PUBLICATIONS

Extended European Search Report, dated Oct. 6, 2015, from corresponding European Application No. 13848913.3.

* cited by examiner

FINANCIAL SELF-SERVICE DEVICE, BANKNOTE RECOGNITION MODULE THEREOF AND RECOGNITION METHOD THEREFOR

CROSS REFERENCE TO RELATED APPLICATION

This application is the national phase of International Application No. PCT/CN2013/073640, filed on Apr. 2, 2013, which claims the priority of Chinese Patent Application No. 201210413529.7, entitled "FINANCIAL SELF-SERVICE DEVICE AND BANKNOTE IDENTIFICATION MODULE AND IDENTIFICATION METHOD THEREOF", filed with the State Intellectual Property Office of PRC on Oct. 25, 2012, which applications are hereby incorporated by reference to the maximum extent allowable by law.

FIELD OF THE INVENTION

The present invention relates to the field of paper medium processing, and particularly relates to a financial self-service device, a banknote identification module and an identification method thereof.

BACKGROUND OF THE INVENTION

The recycling machine generally uses a opposite-type photoelectric sensor mounted at a specific location within the banknote identification apparatus, as a trigger mechanism of "starting" and "ending" of data acquisition, counting and banknote testing in a banknote identification system. However, in practice, a paper banknote with a broken hole or a plastic banknote with a transparent window in the transmission path tends to incline excessively or be too close to each other. For a method using signal hopping of a single opposite-type sensor, which is monitored in real time, as a valid trigger, since a hole may lead to a false triggering/leaving event, more than one starting and triggering events may occur for one banknote. For a method that stops after scanning for fixed time duration, two consecutive banknotes being too close to each other may be mistaken as one triggering event. For plastic banknote issued in different countries, the size and position of the window on the plastic banknote vary. Complicated problems as such may bring troubles to normal count determination, data acquisition and flow control in a paper processing apparatus.

Therefore, it is desirable to provide an appropriate triggering/stopping mode to effectively solve the problems that due to a hole of a banknote and inclination of a banknote in conveying, a scanned image of the banknote may not be complete to be identified, and the count of the banknotes may be incorrect.

SUMMARY OF THE INVENTION

One of objects of the invention is to provide a banknote identification module to effectively monitor a starting event triggered by a banknote and a valid leaving event of the banknote, so as to prevent a false triggering/leaving event, which is caused by banknotes with a hole, from leading to an incomplete image being acquired and subsequent unsuccessful identification of the banknotes.

One further object of the invention is to provide a banknote identification module being able to scan a banknote with an inclination angle to acquire a complete image of the banknote, so as to improve the ability of banknote identification.

Another object of the invention is to provide a banknote identification method executed by the banknote identification module.

The invention further provides a financial self-service device including the banknote identification module.

The banknote identification module includes: a monitoring unit, adapted to monitor in real time a moving state of a banknote in a conveying passage; an acquisition unit, adapted to start or stop acquiring image information of the banknote according to a starting or stopping signal provided by the monitoring unit; a counting unit, adapted to count the number of banknotes according to the times by which the acquisition unit acquires image information; an identification unit, adapted to identify the banknote according to the image data acquired by the acquisition unit and output a final identification result to a main control center for synthetic decision on a destination of the banknote; wherein the monitoring unit includes at least one set of opposite-type sensors, and the set of opposite-type sensors comprises one first sensor and two second sensors; the first sensor is disposed at a central line of the conveying passage, and the two second sensors are disposed at an upstream location from the first sensor in a moving direction of the banknote and arranged symmetrically on two sides of the central line of the conveying passage.

Furthermore, the acquisition unit includes an image sensor, disposed at a downstream location from the set of opposite-type sensors in the moving direction of the banknote, and separated from the set of sensors at a distance so as to guarantee the integrity of the scanned image data of the banknote with an inclination angle.

Preferably, the monitoring unit includes two set of opposite-type sensors. The two set of opposite-type sensors are arranged symmetrically at two ends of the acquisition unit, and are adapted to monitor banknotes moving in two opposite directions respectively. This configuration is applicable for a recycling machine, in which a banknote may enter a banknote box from a banknote entrance/exit via the banknote identification module, or inversely, may enter the banknote entrance/exit from the banknote box via the banknote identification module. Therefore, one set of opposite-type sensors are disposed in each of the two moving direction of a banknote, and the sensors in each set of opposite-type sensors are arranged in a certain pattern, that is, each set of opposite-type sensors includes one first sensor and two second sensors. The first sensor is arranged at the central line of a banknote conveying passage, and the two second sensors are disposed at an upstream location from the first sensor in the moving direction of the banknote, and arranged symmetrically on two sides of the central line of the banknote conveying passage. In other words, each set of opposite-type sensors includes three opposite-type sensors, the three opposite-type sensors are arranged in the Δ shape, the sensor disposed at the top of the Δ shape arrangement is the first sensor, which is disposed at the central line of the banknote conveying passage and at a downstream location from the other two sensors in the moving direction of the banknote, therefore, the first sensor is closer to the image sensor than the other two sensors. The other two opposite-type sensors arranged symmetrically at the bottom of the Δ shape arrangement are the two second sensors, which are disposed at the two sides of the central line of the banknote conveying passage, and at an upstream location from the first sensor in the moving direction of the banknote, therefore, the two second sensors are farther from the image sensor than the first sensor.

The banknote identification method includes: step 1) providing one first sensor and two second sensors at a position where detection is to be performed, wherein the first sensor is disposed at a central line of a banknote conveying passage, and the two second sensors are disposed at an upstream location from the first sensor in a moving direction of a banknote and arranged symmetrically on two sides of the central line of the banknote conveying passage; step 2) monitoring in real time a moving state of the banknote in the banknote conveying passage by the first sensor, and starting an acquisition unit to acquire image data of the banknote when an entering event is triggered by the banknote; step 3) stopping scanning by the acquisition unit when an ending event of the banknote leaving are monitored by all of the first sensor and the two second sensors; and step 4) identifying and verifying, by an identification unit, the banknote according to the image acquired by the acquisition unit through scanning.

Preferably, before step 3), if the latest triggering event does not cause overflowing of an image buffer which forces the acquisition unit to stop scanning, the triggering event of the first sensor is not processed.

Preferably, step 2) is performed again after step 3), to obtain an acquisition starting signal for the next banknote; and step 3) is performed for the next banknote, wherein steps 2) and 3) for the next banknote is performed at the same time as step 4) for the current banknote.

Preferably, step 4) further includes increasing a banknote count by one.

The financial self-service device includes a main control center, an upper mechanism core and a lower mechanism core. The upper mechanism core includes a banknote entrance/exit, a banknote dispensing module, a banknote identification module and a temporary storage module; the lower mechanism core includes a banknote conveying passage and a banknote box; the banknote dispensing module together with the banknote entrance/exit are responsible for receiving a banknote placed at the banknote entrance/exit by a customer and outputting a banknote to be withdrawn by the customer; the banknote identification module receives and processes in real time each banknote separated by the banknote dispensing module; and the main control center returns unqualified banknotes to the banknote entrance/exit, temporarily stores qualified banknotes in the temporary storage module and stores the qualified banknotes into the banknote box after the number of the qualified banknotes is checked; wherein the banknote identification module includes: a monitoring unit, adapted to monitor in real time a moving state of a banknote in the conveying passage; an acquisition unit, adapted to start or stop acquiring image information of the banknote according to a starting or stopping signal provided by the monitoring unit; an counting unit, adapted to count the number of banknotes according to the times by which the acquisition unit acquires image information; an identification unit, adapted to identify the banknote according to the image data acquired by the acquisition unit and output the final identification result to the main control center for synthetic decision on a destination of the banknote; wherein the monitoring unit comprises at least one set of opposite-type sensors, and the set of opposite-type sensors comprises one first sensor and two second sensors; the first sensor is disposed at a central line of the banknote conveying passage, and the two second sensors are disposed at an upstream location from the first sensor in a moving direction of the banknote and arranged symmetrically on two sides of the central line of the banknote conveying passage.

Further more, the acquisition unit includes an image sensor disposed at a downstream location from the set of opposite-type sensors in the moving direction of the banknote and separated from the set of opposite-type sensors at a distance.

Preferably, the monitoring unit includes two set of opposite-type sensors arranged symmetrically at two ends of the acquisition unit and adapted to monitor banknotes moving in two opposite directions.

As the banknote identification apparatus adopts a monitoring unit in which the three opposite-type sensors are arranged in the Δ shape: the first sensor is disposed at the central line of the conveying passage of the banknote, and the two second sensors are disposed at an upstream location from the first sensor in the moving direction of the banknote and arranged symmetrically at two sides of the central line of the banknote conveying passage. With the banknote identification method, whether an entering event triggered by the banknote is monitored by the first sensor is adopted as a condition for determining whether the starting signal of the acquisition unit for image data is valid, and whether the ending event of the banknote leaving is monitored by the three opposite-type sensors including the first sensor and the two second sensors is adopted as the condition for determining whether the ending signal of the acquisition unit is valid, so as to guarantee that one banknote with a hole would not cause a false leaving event and a case of more than one starting and triggering event present for a same banknote. That is, as the first sensor is disposed at a downstream location in the moving direction of the banknote and arranged at the central line of the conveying passage of the banknote, the banknote entering being detected by the first sensor can be adopted as the sufficient condition which allows the banknote to enter into the identification module, and it is reasonable to adopt the trigger of the first sensor as the starting signal of the acquisition unit. As for the case that the banknote leaving is detected by all three sensors the probability of occurrence of holes of one banknote present at the positions of all the three sensors is very small, the banknote leaving being detected by all of the three opposite-type sensors can be adopted as the sufficient condition of the banknote leaving, and it is reasonable and sufficient to adopt the banknote leaving detected by all of the three opposite-type sensors as the ending signal to stop scanning by the acquisition unit. Therefore, compared to a prior art in which the moving state of the banknote is detected by one opposite-type sensor and the signal hopping of the sensor is adopted as a starting or stopping signal of the acquisition unit, the following problems may be solved: due to the false leaving event of a banknote with a hole, the banknote can not be identified and counted correctly.

Furthermore, as the banknote entering being detected by the first sensor disposed at a downstream location and arranged at the central line of the conveying passage of the banknote is adopted as the starting signal of the acquisition unit, the image acquisition is not started until the banknote entering is sufficiently confirmed, so as to prevent acquiring a number of blank regions to occupy the valid buffer reserved for an image of each banknote, which may cause the stored image to be incomplete. Also, when the banknote enters into the identification module obliquely, the inclined part of the banknote already enters into the identification module when the banknote entering is detected by the first sensor. However, as a distance is set between the first sensor and the image sensor, it can be guaranteed that the part of the banknote entering into the identification module does not arrival at the region of the image sensor when the banknote entering is monitored by the first sensor, thereby, the acquisition unit can scan completely the banknote to acquire a complete image of the banknote. Therefore, in the present invention the acquired image may be guaranteed to be complete and the failure or error in identifying the banknote due to the incompleteness of the image may be prevented.

DETAILED DESCRIPTION OF THE INVENTION

The technical solutions according to embodiments of the invention will be described below in detail and fully in conjunction with the drawings.

Figure 1:
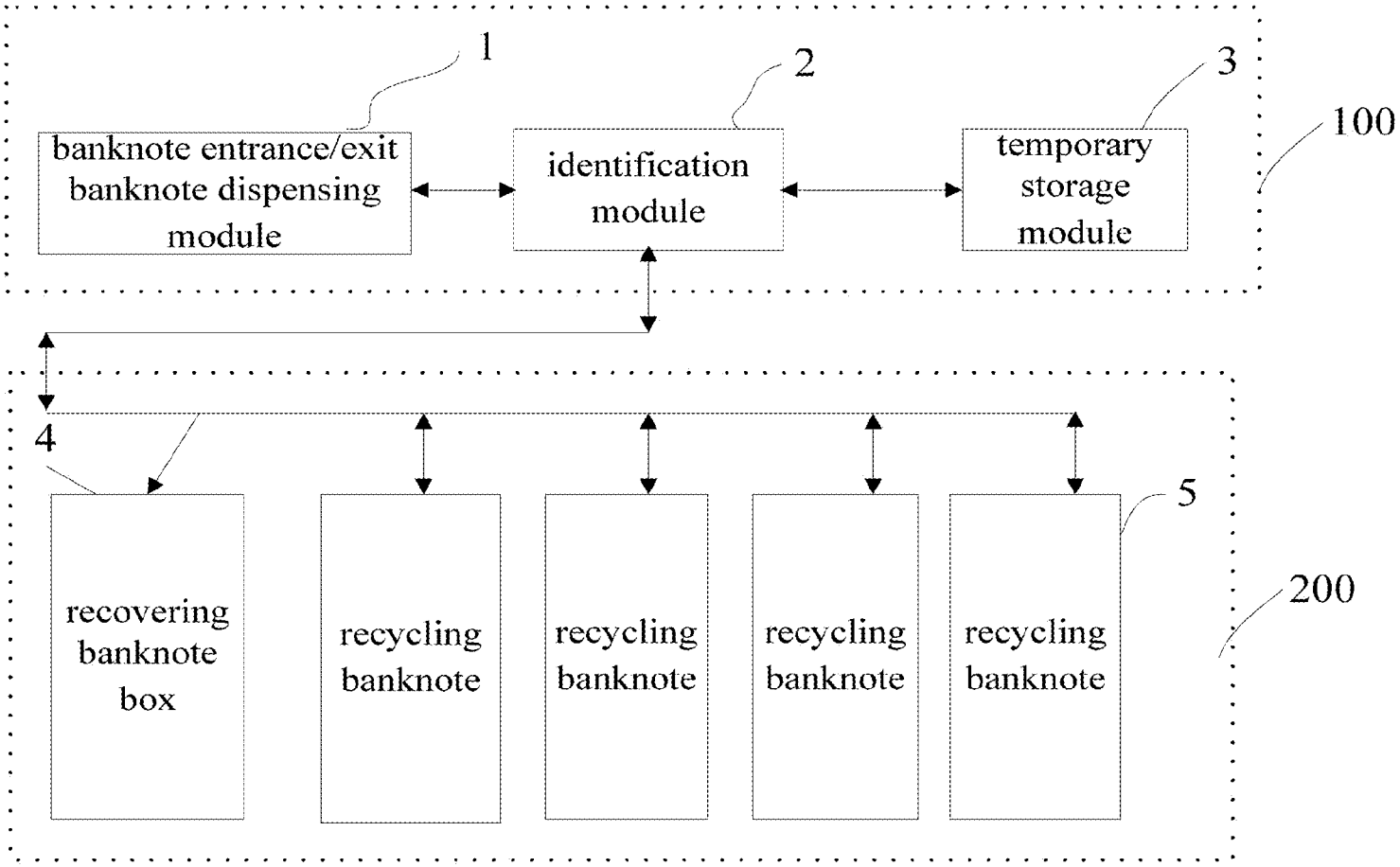
FIG. 1 is a system block diagram of the financial self-service device according to the embodiment.

First, a financial self-service device according to the embodiment is described by an example of a recycling machine. FIG. 1 shows a system block diagram of the financial self-service device provided with a recycling mechanism core according to the embodiment. The financial self-service device includes an upper mechanism core 100 and a lower mechanism core 200. The upper mechanism core includes a banknote dispensing module 1, a banknote identification module 2 and a temporary storage module 3. The lower mechanism core includes a banknote conveying passage, a recovering banknote box 4 and a recycling banknote box 5.

Figure 2:
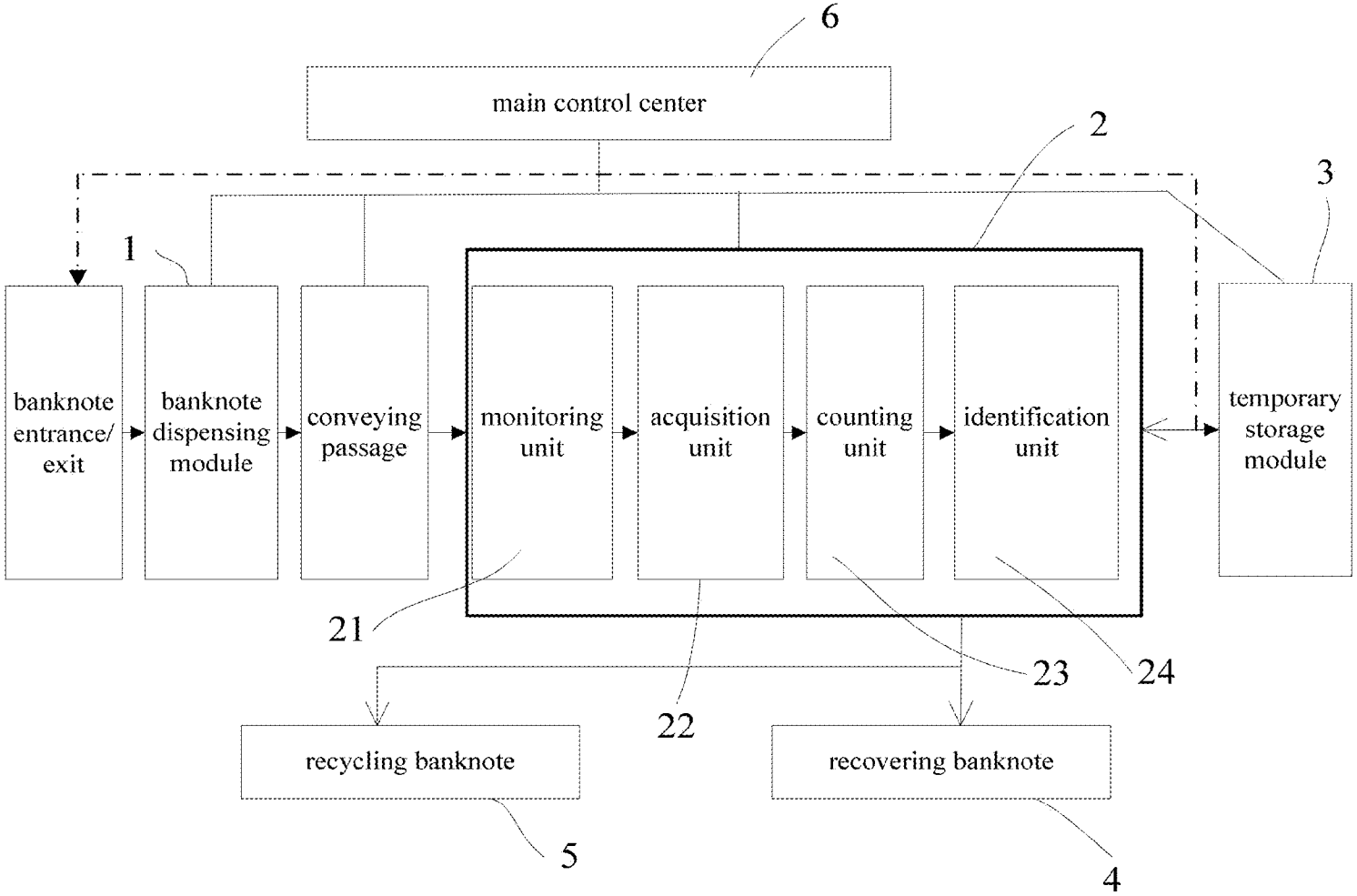
FIG. 2 is a schematic flowchart of deposition.

FIG. 2 is a schematic flowchart of counting and deposition in the recycling machine. The banknote dispensing module together with a banknote entrance/exit are responsible for receiving a banknote placed in the banknote entrance/exit by a customer and outputting a banknote to be withdraw by the customer. The banknote identification module 2 receives and processes in real time each banknote separated by the banknote dispensing module 1. A main control center 6 returns unqualified banknotes back to the entrance/exit, and the conveying path of the unqualified banknotes is indicated by the dashed lines in FIG. 2. The main control center 6 temporarily stores temporarily qualified banknotes into the temporary storage module 3, and then stores the qualified banknotes into the recovering banknote box 4 or the recycling banknote box 5 after the number of the qualified banknotes is checked; the conveying path of the qualified banknotes is indicated by the open arrows the in FIG. 2.

The banknote identification module 2 includes a monitoring unit 21, an acquisition unit 22, a counting unit 23 and an identification module 24. The monitoring unit 21 acquires the movement and position information of the banknote by a opposite-type sensor within the monitoring unit 21; The acquisition unit 22 includes a contact image sensor (CIS), a magnetic sensor and related acquisition, control and storage circuits, and is adapted to start or stop acquiring the image information of the banknote according to a starting or stopping signal provided by the monitoring unit; The counting unit 23 counts the valid number of banknotes according to the times of image acquisition; the identification unit 24 identifies the banknote according to the acquired image data and output a final identification result to the main control center 6.

Figure 3:
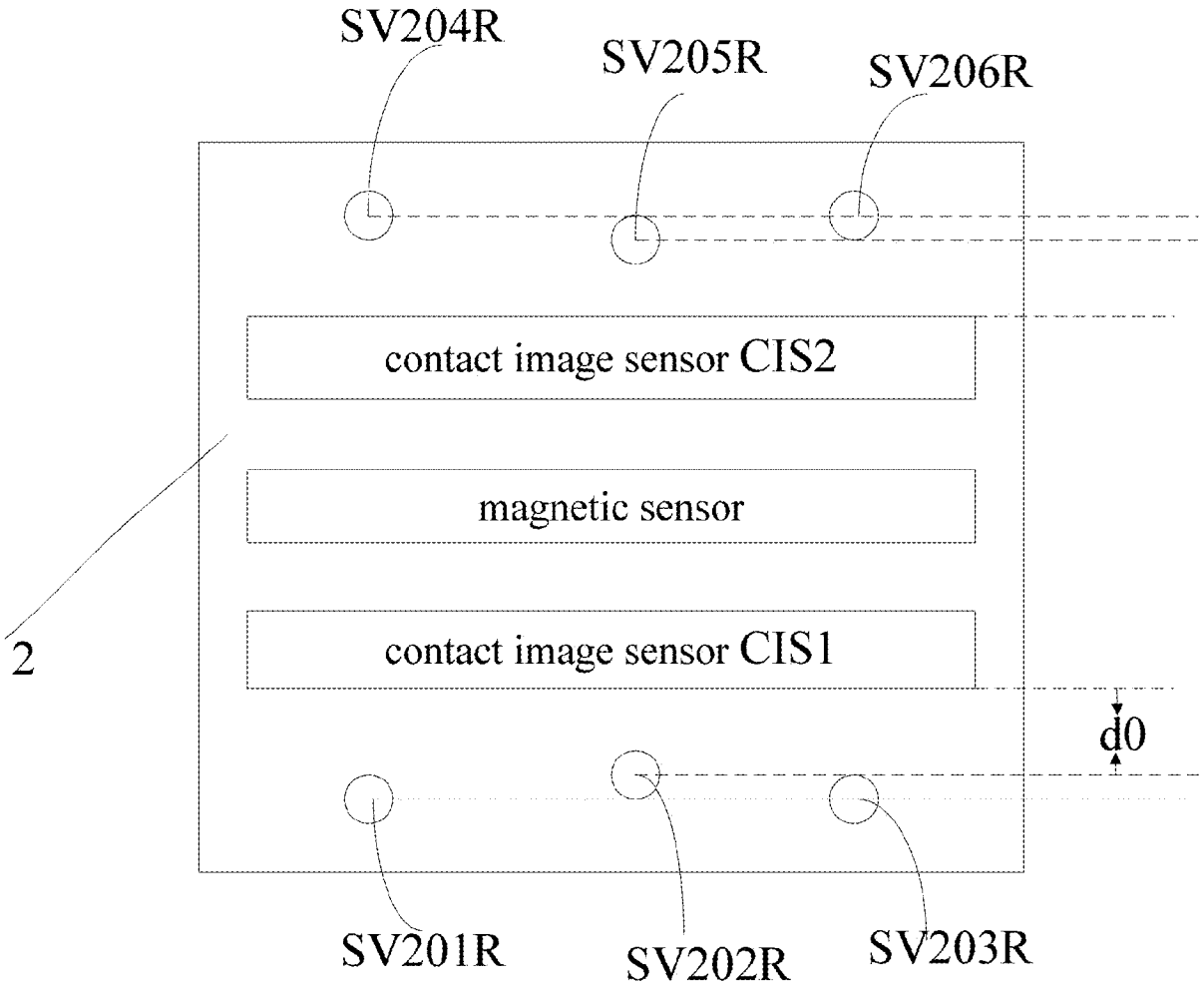
FIG. 3 is a schematic top view of the layout of sensors within the monitoring unit.

The core part of the monitoring unit 21 is a opposite-type photoelectric sensor, and FIG. 3 shows the layout of the sensors within the monitoring unit 21. The acquisition unit 22 including a contact image sensor and a magnetic sensor is disposed at the middle of the identification module 2, and the monitoring unit 21 is disposed at the top and the bottom of the identification module 2. The monitoring unit 21 includes two set of opposite-type sensors, and each set includes three opposite-type sensors arranged in the Δ shape. The first set includes opposite-type sensors SV201R, SV202R and SV203R, and the second set includes SV204R, SV205R and SV206R. The character "R" indicates the receiving end and the character "E" indicates the emitting end. In the top view, the receiving end R is at the top of the emitting end E, and therefore only R is marked. That is, the monitoring unit includes at least one set of opposite-type sensors, and the set of opposite-type sensors includes one first sensor and two second sensors. The first sensor is disposed at the central line of the banknote conveying passage, and the two second sensors are disposed at an upstream location from the first sensor in the moving direction of the banknote and arranged symmetrically at two sides of the central line of the banknote conveying passage. It is to be noted that although the sensors are referred to as the first sensor and the second sensor, they are the same as each other except for respective positions. For the case of recycling machine in this embodiment, the banknote can move in two directions as required. In order to process banknotes moving in two directions, one set of opposite-type sensors is disposed at the top of the identification module 2 and another set is disposed at the bottom of the identification module 2. In each set of opposite-type sensors, the first sensor, i.e., SV202R or SV205R in this embodiment, is disposed at a downstream location in the moving direction of the banknote. The first sensors SV202R and SV205R are closer to CIS (contact image sensor) than the other four opposite-type sensors, i.e., the three opposite-type sensors arranged in the Δ shape in each set of opposite-type sensors. In this configuration, the banknote with a big inclination angle may be processed in a better way, and the banknote with a hole may be processed with the banknote identification method implemented in software. Also, all of the opposite-type sensors are separated from the CIS (contact image sensor) at a distance d0, so as to guarantee the integrity of the scanned image data of the banknote with an inclination angle.

An embodiment of the banknote identification method is introduced in detail below.

The banknote identification method according to the embodiment includes: step 1) providing one first sensor and two second sensors at a position where detection is to be performed, wherein the first sensor is disposed at a central line of a banknote conveying passage, and the two second sensors are disposed at an upstream location from the first sensor in a moving direction of a banknote and arranged symmetrically on two sides of the central line of the banknote conveying passage; step 2) monitoring in real time a moving state of the banknote in the banknote conveying passage by the first sensor, and starting an acquisition unit to acquire image data of the banknote when an entering event is triggered by the banknote; step 3) stopping scanning by the acquisition unit when an ending event of the banknote leaving are monitored by all of the first sensor and the two second sensors; and step 4) identifying and verifying, by an identification unit, the banknote according to the image acquired by the acquisition unit through scanning. It is to be noted that, before step 3), if the latest triggering event does not cause the overflowing of an image buffer which forces the acquisition unit to stop scanning, the triggering event of the first sensor is not processed; the triggering event of the first sensor is monitored immediately after step 3) so as to acquire the starting signal for the next banknote. That is, any triggering event of the first sensor caused by a hole is not processed until the current banknote left the position where the detection is to be performed, so as to prevent one banknote from causing multiple triggering events. When the current banknote left the detection position and the stage of image identification is started, i.e., step 4) is performed, the image data acquisition of the next banknote may be started immediately, and the image data acquisition for the next banknote may be performed at the same time as the image identification for the current banknote so as to improve the efficiency of the identification.

Preferably, the triggering event of the first sensor is monitored in real time after step 3), to acquire an acquisition starting signal for the next banknote, and then step 3) is performed once again, to acquire an acquisition stopping signal for the next banknote. The step of monitoring in real time the triggering event of the first sensor to acquire an acquisition starting signal for the next banknote and the step 3) performed once again are performed at the same time as step 4) for the current banknote. That is, the image data acquisition for next banknote is performed at the same time as the image identification for the current banknote, so as to improve the efficiency of the identification.

Preferably, step 4) further includes increasing a banknote count by one.

The banknote identification by the banknote identification module is described below in conjunction with the drawings. First, the changing of a level of an opposite-type photoelectric sensor is described by taking SV201 as an example. SV201 includes an emitting end SV201E and a receiving end SV201R. Before a banknote enters the identification module 2, i.e., the banknote does not block the infrared light signal emitted from SV201E to SV201R, the signal output from the receiving end SV201R is a high level; Once the front edge of the banknote arrives at a position between SV201R and SV201E, i.e., the banknote already blocks the infrared light emitted by SV201E, the signal of SV201R hops from the high level to a low level, and the duration of the low level is dependent on the width and speed of the banknote in the moving direction of the banknote, i.e., t=s/v. After the back edge of the banknote leaves SV201E, the signal of SV201R is recovered to a high level. The moving state of the banknote in the conveying passage can be detected according to the change between a high level and a low level at the receiving end, and the subsequent flow of acquisition, counting and identification and so on may be performed accordingly. Apparently, in this embodiment it is not intended to take the level hopping signals of SV201E and SV201R as the signals for starting or stopping the acquisition unit, but only to illustrate the relation between the level hopping of any opposite-type sensor and the block caused by the banknote by taking SV201E and SV201R as an example.

Figure 4:
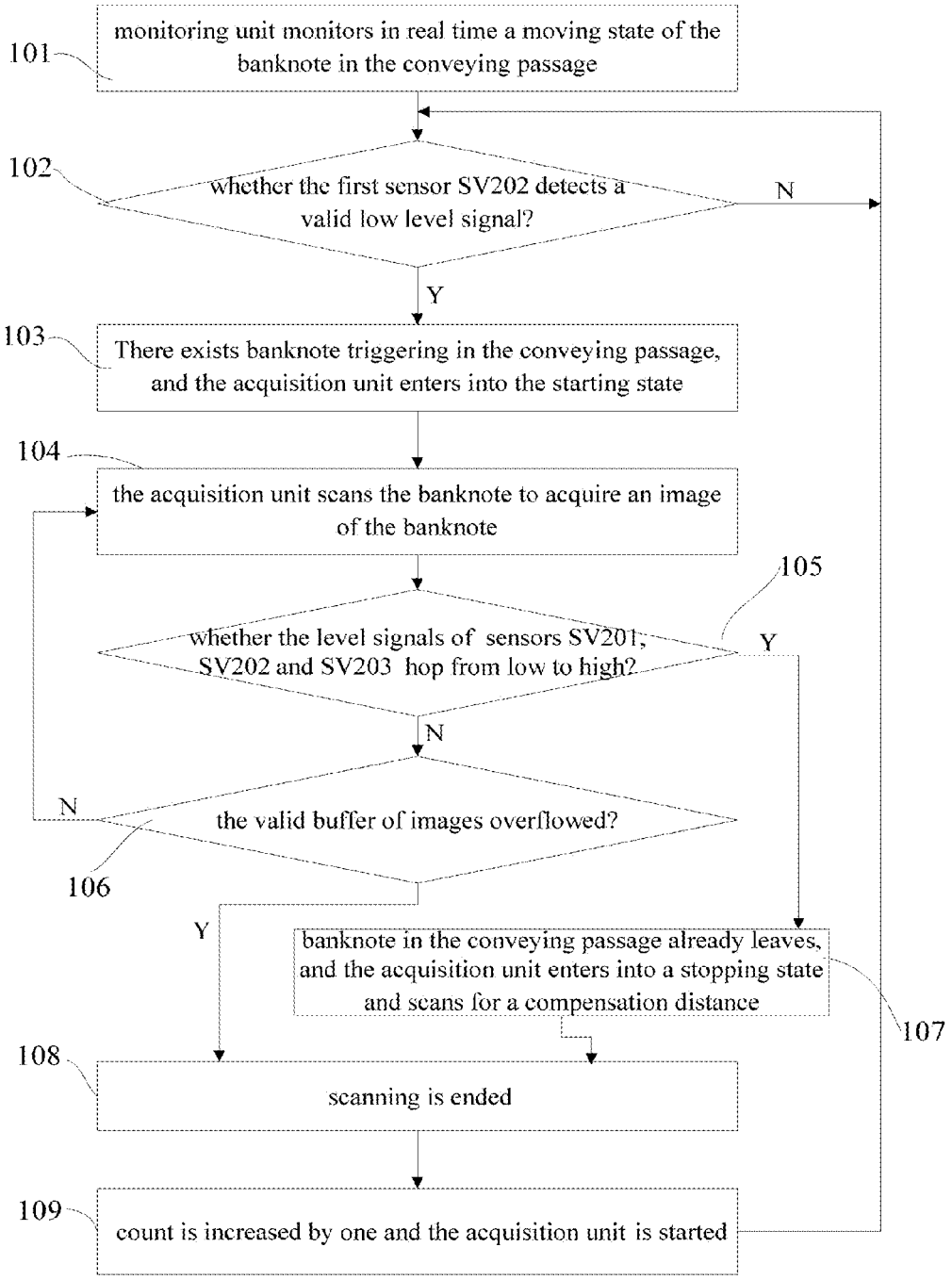
FIG. 4 is a flowchart of the banknote identification method.

FIG. 4 is a flowchart of the banknote identification method.

First, step 101 of monitoring in real time, by the monitoring unit, the moving state of the banknote in the conveying passage is performed. Then step 102 of judging whether the receiving end SV202E of the first opposite-type sensor detects a valid low level signal is performed. If the valid low level signal is deterred by the receiving end SV202E of the first opposite-type sensor, the process proceeds to step 103 of determining the banknote triggering in the banknote conveying passage, which cause the acquisition unit to be started; otherwise, the process returns back to step 102 of judging whether the receiving end SV202E of the first opposite-type sensor detects a valid low level signal. After step 103, the process proceeds to step 104 of scanning the image, and then proceeds to step 105 of judging whether all of the three sensors SV201E, SV202E, SV203E hop from a low level to a high level. If all of the three sensors SV201E, SV202E, SV203E hop from a low level to a high level, the process proceeds to step 107 of determining that the banknote already leaves in the conveying passage, which causes the acquisition unit to be stopped, and scanning for a compensation distance, and then the process proceeds to step 108 of ending the scanning; otherwise, the process proceeds to step 106 of judging whether the valid image buffer is overflowing, if the valid image buffer is overflowing, the process proceeds to step 108 of ending the scanning, and if the valid buffer is not overflowing, the process returns back to step 104 of keeping on scanning the banknote. After step 108 of ending the scanning, the process proceeds to step 109 of increasing the banknote count by one and starting the identification unit to identify the legitimacy of the banknote. It should be noted that in the process of scanning the image by the acquisition unit, a new starting signal of the acquisition unit is not generated even if a new triggering event occurs. That is, before the acquisition unit acquires a stopping signal, or in the case that the acquisition unit is not forced to stop scanning due to the overflowing of the valid buffer, in step 102, the new triggering event is still not processed even if a valid low level signal is detected once again by the receiving end SV202E of the first opposite-type sensor, and the triggering event is considered by default to be caused by a hole rather than triggered by a new banknote.

The banknote identification method according to the embodiment adopts a pipeline type process in which the control of the image data acquisition and the banknote identification are performed at the same time. In order to effectively solve the problems brought by a plastic banknote with a hole, with the layout of opposite-type sensors shown in FIG. 3, whether the first sensor SV202 detects the entering event triggered by the banknote is regarded as the condition for determining whether the starting signal of the image data acquisition unit is valid, and whether all of the first sensor SV202 and the two second sensors SV201 and SV203 detect the ending event triggered by the banknote leaving are regarded as the condition for determining whether the ending signal of the acquisition unit is valid. That is, the level signal of SV202R hops from a high level to a low level when SV202 is blocked by the banknote, at this time, the acquisition unit is started, and normally the level signal of SV201 and SV203 already hops from a high level to a low level, i.e., SV201 and SV203 are in the blocked state. While in the case that the banknote inclines or has a hole, one of the sensors may be in the unblocked state for error, and the level signal of this sensor hops from a low level to a high level. However, the stopping signal for the acquisition unit would not be generated for this case, and only when all of the three opposite-type sensors SV202, SV201 and SV203 hop from a high level to a low level, the stopping signal for the acquisition unit is generated to stop the image data acquisition of the current banknote by the acquisition unit. Furthermore, according to the embodiment, the ping-pong buffer is used to store the images, that is, the storage is performed immediately after the image data acquisition of the current banknote, and at this time, the next banknote may already trigger the starting of the acquisition unit to acquire the image data of the next banknote. Furthermore, in the control flow of the banknote identification, the identification of the current banknote and the image acquisition of the next banknote are performed at the same time, so as to achieve the effect of performing the identification and acquisition concurrently, therefore, the identification efficiency is greatly improved.

In this embodiment, the layout of the opposite-type sensors as shown in FIG. 3 is adopted. The signal change of SV202 is adopted as a sufficient condition for starting the acquisition unit, and a hole at the edge of the banknote will not affect the determination of the starting signal, therefore, there will be no more than one triggering event. Also, a distance d0 is kept between the opposite-type sensor and the image contact sensor, and with pre-scanning conducted via software, the front edge of the banknote can be completely scanned when the banknote inclines. That is, due to the setting of the distance d0, the banknote is not scanned until the front edge of the banknote arrives at the front edge of the image sensor CIS, i.e., scanning of the banknote is not started until the banknote travels for a distance of d0 after arrives at SV202. When the front edge of the banknote arrives at SV202, the acquisition unit performs scanning for the banknote in advance by a threshold (e.g., 20 lines in advance) set by a program; therefore, the sharp corner of the front edge of the inclined banknote can be stored in the upper half of the image buffer.

According to the rule of taking the case that all of level signals of the three sensors hop to a high level as the end of the banknote leaving, the three sensors are arranged in the Δ shape, and with a compensation scanning performed via software, the end of the inclined banknote can be scanned completely. That is, due to the setting of the distance d0, the scanning of the banknote is not stopped until the banknote leaves the back edge of the image sensor CIS, i.e., travels for the distance of d0 after leaves SV202. When the banknote leaves SV202, the acquisition unit delays the scanning and the acquisition of the banknote by a threshold (e.g., 20 lines for compensation) set by a program, so as to store the image of the sharp corner of the back end of the inclined banknote in the lower half of the image buffer.

In order to normally scan and count for two banknotes which have a too small distance between them, when the monitoring unit detects a valid leaving event of a banknote, the flow of the banknote identification is entered under control, and the triggering event of the first sensor is monitored immediately in real time, so as to store a flag of staring scanning for the next banknote. Such a banknote identification method can solve the problem which can not be processed by a fixed extent scanning.

Particular embodiments of the present invention are disclosed above, which should be interpreted as limiting the protective scope of the present invention. Alternations or modifications made to the technical solutions of the present invention by those skilled in the art without deviating from the technical scope of the invention fall within the protective scope of the invention. Therefore, the protective scope of the invention is defined by the claims.

The invention claimed is:

1. A banknote identification module comprising:

a monitoring unit, adapted to monitor in real time a moving state of a banknote in a conveying passage;

an acquisition unit, adapted to start or stop acquiring image information of the banknote according to a starting or stopping signal provided by the monitoring unit;

a counting unit, adapted to count the number of banknotes according to the times by which the acquisition unit acquires image information;

an identification unit, adapted to identify the banknote according to the image data acquired by the acquisition unit and output a final identification result to a main control center for synthetic decision on a destination of the banknote;

wherein the monitoring unit comprises at least one set of opposite-type sensors, and the set of opposite-type sensors comprises one first sensor and two second sensors; the first sensor is disposed at a central line of the conveying passage, and the two second sensors are disposed at an upstream location from the first sensor in a moving direction of the banknote and arranged symmetrically on two sides of the central line of the conveying passage, wherein the acquisition unit comprises a image sensor disposed at a downstream location from the set of opposite-type sensors in the moving direction of the banknote and separated from the set of opposite-type sensors at a distance; the distance between the second sensor and the image sensor is greater than the distance between the first sensor and the image sensor.

2. The banknote identification module according to claim 1, wherein the monitoring unit comprises two sets of opposite-type sensors disposed symmetrically at two ends of the acquisition unit and adapted to monitor banknotes moving in two opposite directions respectively.

3. A banknote identification method comprising:

step 1) providing one first sensor and two second sensors at a position where detection is to be performed, wherein the first sensor is disposed at a central line of a banknote conveying passage, and the two second sensors are disposed at an upstream location from the first sensor in a moving direction of a banknote and arranged symmetrically on two sides of the central line of the banknote conveying passage;

step 2) monitoring in real time a moving state of the banknote in the banknote conveying passage by the first sensor, and starting an acquisition unit to acquire image data of the banknote when an entering event is triggered by the banknote;

step 3) stopping scanning by the acquisition unit when an ending event of the banknote leaving is monitored by all of the first sensor and the two second sensors; and step 4) identifying and verifying, by an identification unit, the banknote according to the image acquired by the acquisition unit through scanning, wherein before step 3), if a latest triggering event does not cause overflowing of an image buffer which forces the acquisition unit to stop scanning, the triggering event of the first sensor is not processed.

4. The banknote identification method according to claim 3, further comprising:

executing step 2) again after step 3), to obtain an acquisition starting signal for the next banknote; and executing step 3) for the next banknote, wherein steps 2) and 3) for the next banknote is performed at the same time as step 4) for the current banknote.

5. The banknote identification method according to claim 3, wherein step 4) further comprises increasing a banknote count by one.

6. A financial self-service device comprising a main control center, a upper mechanism core and a lower mechanism core, the upper mechanism core comprising a banknote entrance/exit, a banknote dispensing module, a banknote identification module and a temporary storage module; in which the lower mechanism core comprising a banknote conveying passage and a banknote box; the banknote dispensing module together with the banknote entrance/exit being responsible for receiving a banknote placed at the banknote entrance/exit by a customer and outputting a banknote to be withdrawn by the customer;

the banknote identification module receiving and processing in real time each banknote separated by the banknote dispensing module; and the main control center returning unqualified banknotes to the banknote entrance/exit, temporarily storing qualified banknotes in the temporary storage module and storing the qualified banknotes into the banknote box after the number of the qualified banknotes is checked;

wherein the banknote identification module comprises:

a monitoring unit, adapted to monitor in real time a moving state of a banknote in the conveying passage;

an acquisition unit, adapted to start or stop acquiring image information of the banknote according to a starting or stopping signal provided by the monitoring unit;

an counting unit, adapted to count the number of banknotes according to the times by which the acquisition unit acquires image information;

an identification unit, adapted to identify the banknote according to the image data acquired by the acquisition unit and output the final identification result to the main control center for synthetic decision on a destination of the banknote;

wherein the monitoring unit comprises at least one set of opposite-type sensors, and the set of opposite-type sensors comprises one first sensor and two second sensors;

the first sensor is disposed at a central line of the banknote conveying passage, and the two second sensors are disposed at an upstream location from the first sensor in a moving direction of the banknote and arranged symmetrically on two sides of the central line of the banknote conveying passage, wherein the acquisition unit comprises a image sensor disposed at a downstream location from the set of opposite-type sensors in the moving direction of the banknote and separated from the set of opposite-type sensors at a distance, and the distance between the second sensor and the image sensor is greater than the distance between the first sensor and the image sensor.

7. The financial self-service device according to claim 6, wherein the monitoring unit comprises two sets of opposite-type sensors disposed symmetrically at two ends of the acquisition unit and adapted to monitor banknotes moving in two opposite directions respectively.

* * * * *